US007993692B2

(12) United States Patent
Finley et al.

(10) Patent No.: US 7,993,692 B2
(45) Date of Patent: Aug. 9, 2011

(54) PACKAGE ASSEMBLY FOR ON-DEMAND MARINATION AND METHOD FOR PROVIDING THE SAME

(75) Inventors: David M. Finley, Simpsonville, SC (US); Howard Dean Conner, Mauldin, SC (US); Andrew Boyd Carrouth, Jr., Woodruff, SC (US); Terry Millwood, Spartanburg, SC (US)

(73) Assignee: Cryovac, Inc., Duncan, SC (US)

( * ) Notice: Subject to any disclaimer, the term of this patent is extended or adjusted under 35 U.S.C. 154(b) by 381 days.

(21) Appl. No.: 12/208,069

(22) Filed: Sep. 10, 2008

(65) Prior Publication Data

US 2010/0062130 A1 Mar. 11, 2010

(51) Int. Cl.
*B65D 81/32* (2006.01)

(52) U.S. Cl. ..... 426/112; 426/531; 426/106; 426/129; 426/394; 383/38; 206/219; 206/229

(58) Field of Classification Search ..... 426/112, 426/531, 106, 129, 394; 206/219, 221, 222, 206/229; 383/38
See application file for complete search history.

(56) References Cited

U.S. PATENT DOCUMENTS

| | | | |
|---|---|---|---|
| 180,478 | A | 8/1876 | Hill |
| 628,359 | A | 7/1899 | Schindler |
| 654,174 | A | 7/1900 | Murmann |
| 720,435 | A | 2/1903 | Jewett |
| 827,222 | A | 1/1906 | Espenhayn |
| 1,303,618 | A | 5/1919 | Turrettini |
| 1,751,387 | A | 3/1930 | Bielek |
| 1,897,723 | A | 2/1933 | Free |
| 1,899,286 | A | 2/1933 | Meagher |
| 2,112,674 | A | 3/1938 | Lewit |
| 2,245,738 | A | 6/1941 | Taylor |
| 2,265,172 | A | 12/1941 | Katz |
| 2,288,895 | A | 7/1942 | Fink |
| 2,289,007 | A | 7/1942 | Gessler |
| 2,289,008 | A | 7/1942 | Gessler |

(Continued)

FOREIGN PATENT DOCUMENTS

BE 894 377 1/1983

(Continued)

OTHER PUBLICATIONS

Examiner's translation Charpentier FR 2 642 726, Aug. 1990.*

(Continued)

*Primary Examiner* — Drew E Becker
*Assistant Examiner* — Chaim Smith
(74) *Attorney, Agent, or Firm* — Alston & Bird LLP

(57) ABSTRACT

A package assembly including a first package a second package is provided. The first package can contain two or more compartments. A first compartment can substantially contain the second package and a second compartment can substantially contain a food product, such as a meat. The second package can contain a food additive, such as a marinade. Although substantially contained within the first compartment of the first package, the second package includes a reputable seal located proximate the second compartment of the first package. Applying pressure to the first compartment and, thus, the second package can break the rupturable seal to distribute the food additive from the second package to the food product in the second compartment. The first package can include a perimeter hard seal configured to withstand the pressure and, thus, prevent the leaking of any of the food product or the food additive from the first package during the distribution of the food additive.

20 Claims, 6 Drawing Sheets

U.S. PATENT DOCUMENTS 2,300,793 A 11/1942 Martin
2,327,447 A 8/1943 O'Brien
2,613,664 A 10/1952 Rivoche
2,620,788 A 12/1952 Rivoche
2,693,793 A 11/1954 Steven
2,733,709 A 2/1956 Sukacev
2,916,886 A 12/1959 Robbins
2,968,932 A 1/1961 Vance
3,328,136 A 6/1967 Verakas, Jr.
3,542,032 A 11/1970 Spencer, Jr.
3,756,386 A 9/1973 Marckardt
3,812,043 A 5/1974 Van Der Linde
3,865,117 A 2/1975 Perry, III
3,970,068 A 7/1976 Sato
3,983,994 A 10/1976 Wyslotsky
4,064,296 A 12/1977 Bornstein et al.
4,120,716 A 10/1978 Bonet
4,278,738 A 7/1981 Brax et al.
4,334,519 A 6/1982 Cieslak
4,510,919 A 4/1985 Benmussa
4,528,218 A 7/1985 Maione
4,573,447 A 3/1986 Thrash
4,640,264 A 2/1987 Yamaguchi
4,722,323 A 2/1988 Oblon
4,741,324 A 5/1988 Ina
4,751,119 A 6/1988 Yukawa
4,752,310 A 6/1988 Maier-Laxhuber
4,753,085 A 6/1988 Labrousse
4,793,323 A 12/1988 Guida
4,809,673 A 3/1989 Charvin
4,838,242 A 6/1989 Oblon
4,844,251 A 7/1989 Gueret
4,879,430 A 11/1989 Hoffman
4,989,729 A 2/1991 Huang
5,035,230 A 7/1991 Steidl
5,167,973 A 12/1992 Snyder
5,168,708 A 12/1992 Siegel
5,209,348 A 5/1993 Schafer, III
5,220,909 A 6/1993 Pickard
5,263,991 A 11/1993 Wiley
5,287,961 A 2/1994 Herran
5,351,675 A 10/1994 Brodsky
5,388,565 A 2/1995 Ou
5,392,762 A 2/1995 Hsu
5,465,707 A 11/1995 Fulcher
5,483,949 A 1/1996 James
5,486,371 A 1/1996 Chen
5,496,575 A 3/1996 Newarski
5,514,394 A 5/1996 Lenahan
5,517,981 A 5/1996 Taub
5,542,418 A 8/1996 James
5,626,022 A 5/1997 Scudder
5,628,304 A 5/1997 Freiman
5,662,096 A 9/1997 Walters
5,809,786 A 9/1998 Scudder
5,915,461 A 6/1999 Tanhehco
5,941,078 A 8/1999 Scudder
5,979,164 A 11/1999 Scudder
6,003,673 A 12/1999 Vieu
6,079,405 A 6/2000 Justo
6,178,753 B1 1/2001 Scudder
6,234,165 B1 5/2001 Creighton
6,289,889 B1 9/2001 Bell
6,338,252 B1 1/2002 Calderaio
6,341,602 B1 1/2002 Fulcher
6,393,843 B2 5/2002 Kohout
6,427,761 B1 8/2002 Georges
6,484,514 B1 11/2002 Joseph
6,547,063 B1 4/2003 Zaveri
6,601,576 B1 8/2003 Baysinger, Jr.
6,601,577 B2 8/2003 Bouskila
6,635,077 B2 10/2003 Grissmeyer
6,698,504 B2 3/2004 Briesmeister
6,705,309 B2 3/2004 Searle
6,726,386 B1 4/2004 Gruenbacher et al.
6,743,451 B2 6/2004 Rasile et al.
6,766,797 B1 7/2004 Lavigne
6,866,145 B2 3/2005 Richards et al.
6,895,763 B1 5/2005 Seymour
6,902,335 B2 6/2005 Bergey et al.
6,920,873 B2 7/2005 Venkatesan
6,935,492 B1 8/2005 Loeb
6,938,394 B2 9/2005 Perell
6,948,490 B2 9/2005 Searle
6,962,149 B2 11/2005 Kolb
6,974,025 B2 12/2005 Bertram et al.
6,986,345 B2 1/2006 Kolb
7,021,064 B2 4/2006 Wohland
7,021,848 B1 4/2006 Gruenbacher
7,025,055 B2 4/2006 Scudder
7,081,211 B2 7/2006 Li
7,235,187 B2 6/2007 Li
7,243,788 B2 7/2007 Schmidt
7,258,117 B2 8/2007 Payen
7,311,660 B2 12/2007 Gomez
7,350,361 B2 4/2008 Maxwell et al.
7,350,362 B2 * 4/2008 Danwoody ..... 62/4
7,371,268 B2 5/2008 Smith
2001/0029741 A1 10/2001 Peters
2001/0039947 A1 11/2001 Searle
2002/0017291 A1 2/2002 Searle
2002/0020407 A1 2/2002 Wohland
2002/0054941 A1 * 5/2002 Calkins et al. ..... 426/281
2002/0104527 A1 8/2002 Ichikawa
2002/0129610 A1 9/2002 Searle
2002/0162549 A1 11/2002 Kolb
2002/0174863 A1 11/2002 Saric
2003/0000517 A1 1/2003 Joseph
2003/0205224 A1 11/2003 Kolb
2004/0065315 A1 4/2004 Fish
2004/0181451 A1 9/2004 Boeckerman et al.
2004/0206346 A1 10/2004 Tenenboum
2005/0160743 A1 7/2005 Dunwoody
2005/0198968 A1 9/2005 Scudder
2005/0198969 A1 9/2005 Scudder
2005/0235653 A1 10/2005 Valbh
2005/0279106 A1 12/2005 Leonzo
2006/0005827 A1 1/2006 Consoli
2006/0118434 A1 6/2006 Leiner et al.
2006/0162344 A1 7/2006 Scudder
2006/0169276 A1 8/2006 Scudder
2006/0191272 A1 8/2006 Wohland
2006/0260326 A1 11/2006 Hickey
2007/0089730 A1 4/2007 Gunz
2007/0125362 A1 6/2007 Ford
2007/0125667 A1 6/2007 Lee et al.
2007/0227524 A1 10/2007 Murakami
2008/0178865 A1 7/2008 Retterer
2009/0032413 A1 2/2009 Huber et al.

FOREIGN PATENT DOCUMENTS

CA 2 306 289 * 8/1999
DE 20 2004 014511 U1 11/2004
FR 2 642 726 A 8/1990
GB 2 427 601 1/2007
WO WO 96/39342 A 12/1996
WO WO 98/54065 12/1998
WO WO 98/54068 12/1998
WO WO 2006/029600 3/2006
WO WO 2007/076886 7/2007
WO WO 2008/118444 A 10/2008

OTHER PUBLICATIONS

PCT/US2009/053673 International Search Report mailed Oct. 1, 2009.

PCT/US2009/053673 Written Opinion mailed Oct. 1, 2009.

* cited by examiner

PACKAGE ASSEMBLY FOR ON-DEMAND MARINATION AND METHOD FOR PROVIDING THE SAME

BACKGROUND

Of the several sensory characteristics of meat, tenderness is perhaps the trait most highly desired by consumers. Consequently, meat tenderness is a factor of major economic importance to the livestock and meat industries. Accordingly, the consumer acceptance of meat, e.g., beef, pork and poultry, depends to a large measure on the tenderness of the meat after cooking. When the meat is tough and fibrous, consumer acceptance is quite low. Meat prepared for home consumption and sold in local groceries and butcheries is normally of the more tender grades. For example, in the case of beef, lot feeding can be required to develop the desired amount of tenderness in the muscle tissue, including increases in fat content. However, such efforts can considerably increase the cost of the meat. For this reason, significant effort has been expended in the art to provide methods for tenderizing less tender grades of meat.

Commonly, food additives (such as, for example, marinades) can be used to enhance the qualities of meats by providing enhanced visual appearance and tenderness from spices and flavorings. For example, some techniques utilize injection of flavorings into the muscle to impart flavor and juiciness prior to packaging the meat. Other techniques include a means of tumbling a meat product in a marinade prior to packaging. In the case of the injected or tumbled marinade techniques, the use of a tenderizer is often omitted because the proteolytic enzyme associated with tenderizing agents can overly soften the meat, resulting in an unsatisfactory texture. The over-tenderizing results from prolonged contact time between the meat and the tenderizing agent as a consequence of the poor ability to control the exposure time during distribution. Additionally, even without considering the role of a proteolytic enzyme, the quality of a pre-marinated package is necessarily inconsistent as the meat generally is exposed for too long to the flavorants.

Alternatively, restaurants or consumers can purchase a vacuum packaged meat package, cut open the package, and transfer the meat to a second bag wherein a marinade is added, or to a tray or vat that is loaded with a marinade. With the tray, vat, or second bag method, a consumer removes the meat from its shipment package and necessarily exposes the meat to outside conditions that can introduce contamination during marinating. In addition, the method can introduce the undesirable step of cleaning the tray or vat to prevent cross-contamination.

BRIEF SUMMARY

The presently disclosed subject matter provides, among other things, a package assembly that includes first and second packages that maintains two or more components, e.g., a food additive and a food product, separately until a user desires to mix the two components within the package assembly.

For example, according to an embodiment of the present invention, a package assembly form marinating a food product is provided. The package assembly comprises a first package and a second package. The first package includes a first compartment configured to substantially contain the second package and a second compartment configured to substantially contain the food product. The second package is substantially contained within the first compartment of the first package and configured to contain a food additive. The second package includes a rupturable seal configured to rupture when exposed to a predetermined pressure. The second package is in fluid communication with the second compartment of the first package upon the rupturing of the rupturable seal so as to allow the food additive to mix with the food product. The first package includes a hard seal configured to withstand the predetermined pressure and prevent leaking of the food additive and food product from the first package during the mixing of the food additive and the food product.

The first package may include a first plastic film and a second plastic film and the hard seal of the first package may extend around the perimeter of the first plastic film and the perimeter of the second plastic film. The first plastic film may be a thermoformed film formed into a compartmented support member having the first and second compartments.

The second package may include a first plastic film and a second plastic film. The first plastic film may be a thermoformed film formed into a compartmented support member having a compartment. The first plastic film of the second package and the second plastic film of the second package may collectively form a flange of the second package extending away from the compartment and the rupturable seal may extend at least across the flange of the second package. As another example, the rupturable seal may extend around the perimeters of the first and second plastic films of the second package including across the flange.

The first and second compartments of the first package may be separated by a partition and the flange of the second package may extend from the compartment of the second package at least partially across the partition toward the second compartment of the fist package.

The package assembly may further include a seal between the flange and the first plastic film of the first package and a seal between the flange and the second plastic film of the first package.

According to another embodiment, the package assembly includes a food product, a food additive, a first package, and a second package. The first package comprises a first compartment that substantially contains the second package and a second compartment that substantially contains the food product. The second package contains the food additive and includes a rupturable seal configured to rupture and allow the food additive to escape the second package when exposed to a predetermined pressure. The second package is in fluid communication with the second compartment of the first package upon a rupturing of the rupturable seal so as to allow the food additive to mix with the food product. The first package is configured to withstand the predetermined pressure and prevent leaking of the food additive and food product from the first package during the mixing of the food additive and the food product.

The first package may include a first plastic film of the first package and a second plastic film of the first package sealed together by a hard seal configured to withstand the predetermined pressure.

The second package may include a first plastic film of the second package and a second plastic film of the second package sealed together at least partially by the rupturable seal. The first plastic film of the second package and the second plastic film of the second package may collectively form a flange of the second package and the rupturable seal may extend at least across the flange of the second package. As another example, the rupturable seal may extend around the perimeter of the first plastic film of the second package and the perimeter of the second plastic film of the second package. The first and second compartments of the first package may be separated by a partition and the flange of the second package may extend from the first compartment of the first package at least partially across the partition toward the second compartment of the fist package.

The food additive may be selected from the group comprising: marinade, proteolytic enzyme, bactericide, fungicide, preservative, wetting agent, antioxidant, viscosity control agent, brine, curing agent, flavoring agent, and combinations thereof. The food product may be selected from the group comprising: meat, vegetable, and combinations thereof.

According to yet another embodiment, a method of controlling a level of food additive imparted to a food product is provided. The method includes forming a support member of a first package that includes a first compartment configured to substantially contain a second package and a second compartment configured to substantially contain a food product; forming the second package configured to contain a food additive; loading the food additive into the second package; sealing the food additive in the second package with at least a rupturable seal configured to rupture and allow the food additive to escape the second package; loading the food product into the second compartment of the first package; loading the second package substantially into the first compartment of the first package such that the second package is in fluid communication with the second compartment of the first package upon a rupturing of the rupturable seal so as to allow the food additive to mix with the food product; and sealing the support member of the first package with a cover of the first package such that the first package is configured to withstand the predetermined pressure and prevent leaking of the food additive and food product from the first package during the mixing of the food additive and the food product. The method may further include applying a vacuum to the second package during or prior to the sealing of the second package and applying a vacuum to at least the second compartment during or prior to the sealing of the first package.

In other embodiments, the forming of the supporting member may include thermoforming a first plastic film of the first package. The forming of the second packaging may include thermoforming a first plastic film of the second package into a support member of the second package having a compartment of the second package. The loading the second package substantially into the first compartment of the first package may include positioning a flange of the second package at least partially across a partition separating the first compartment of the first package and the second compartment of the first package such that the flange extends from the first compartment of the first package toward the second compartment of the second package.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 5A:
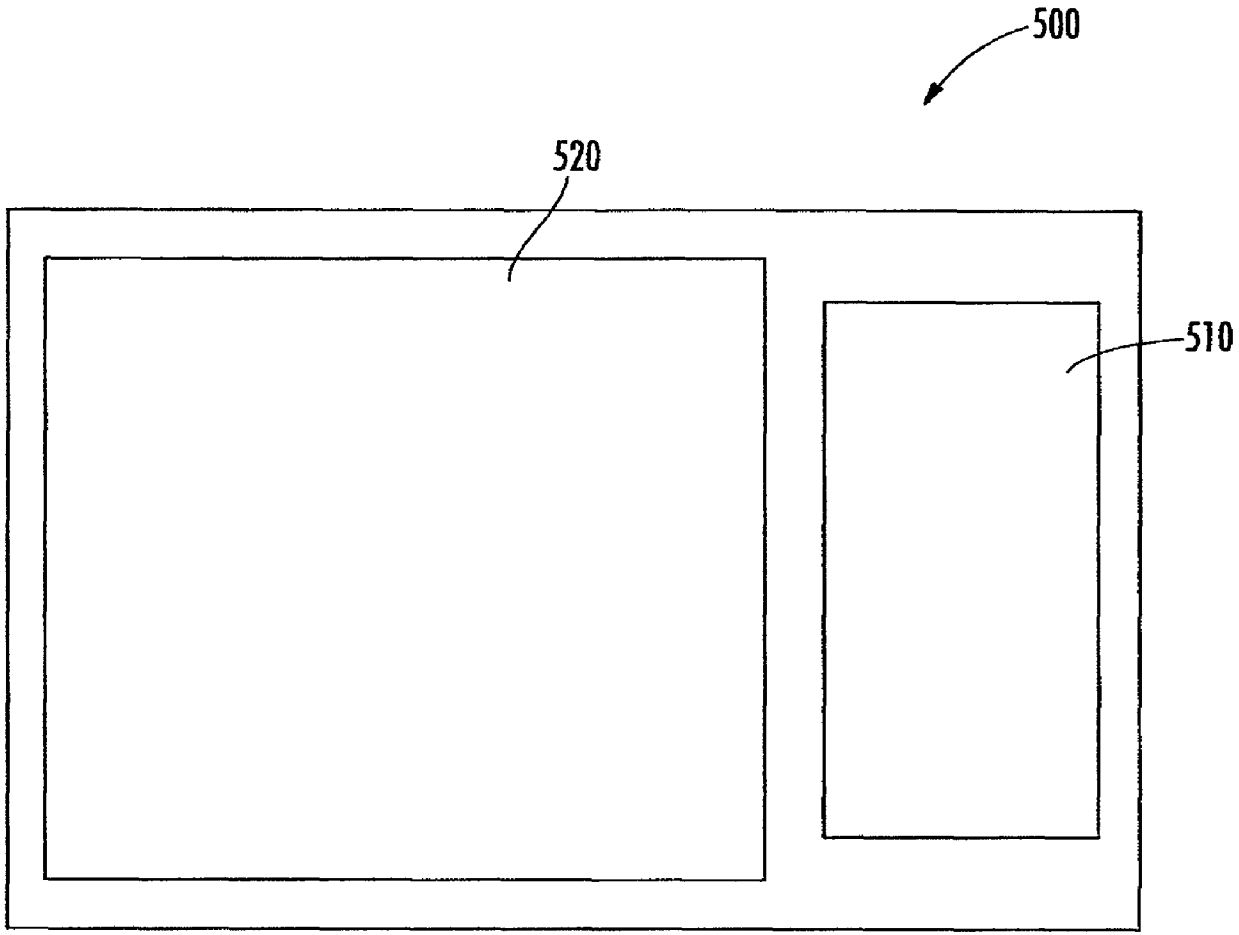
Figure 5B:
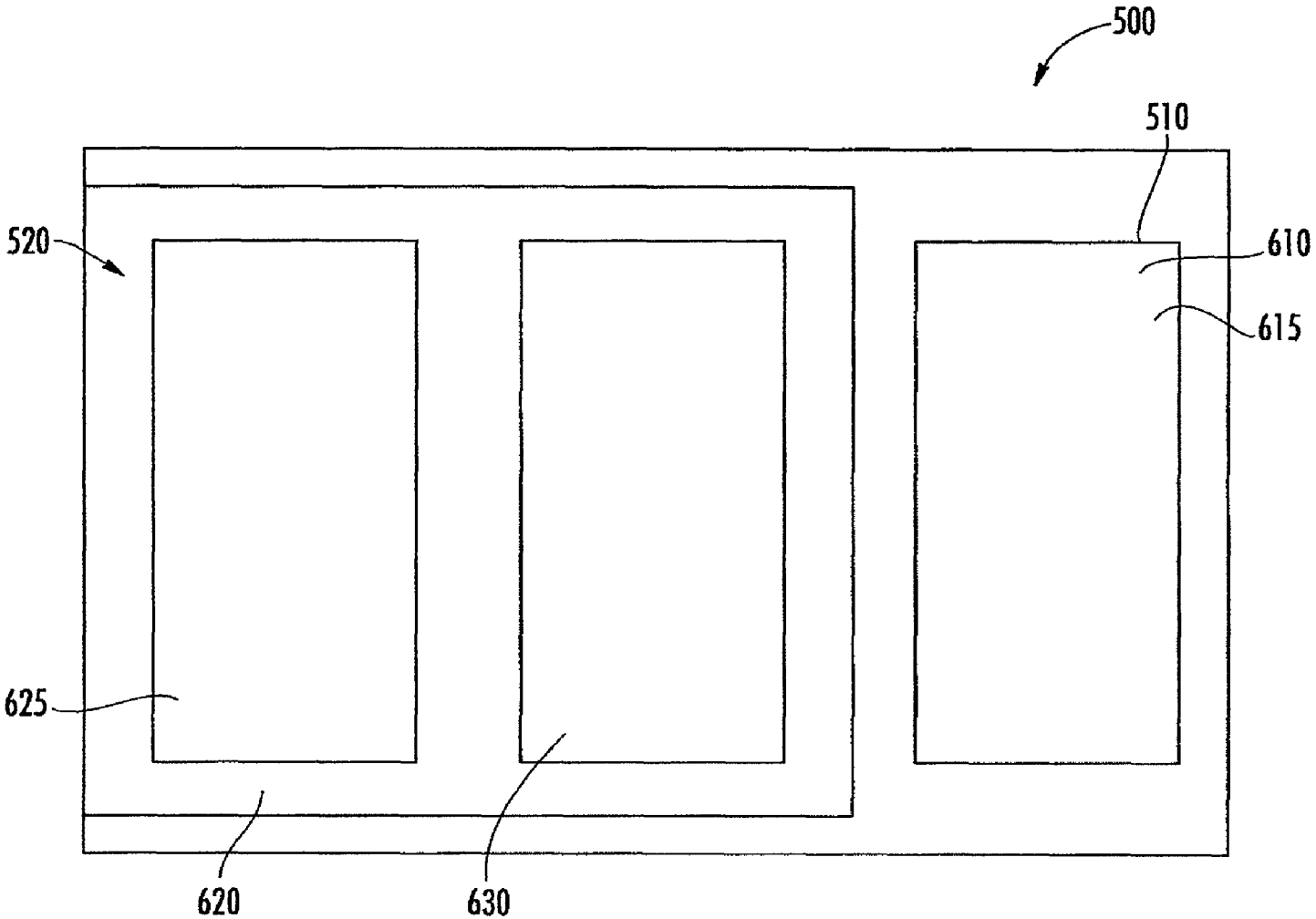
Figure 6:
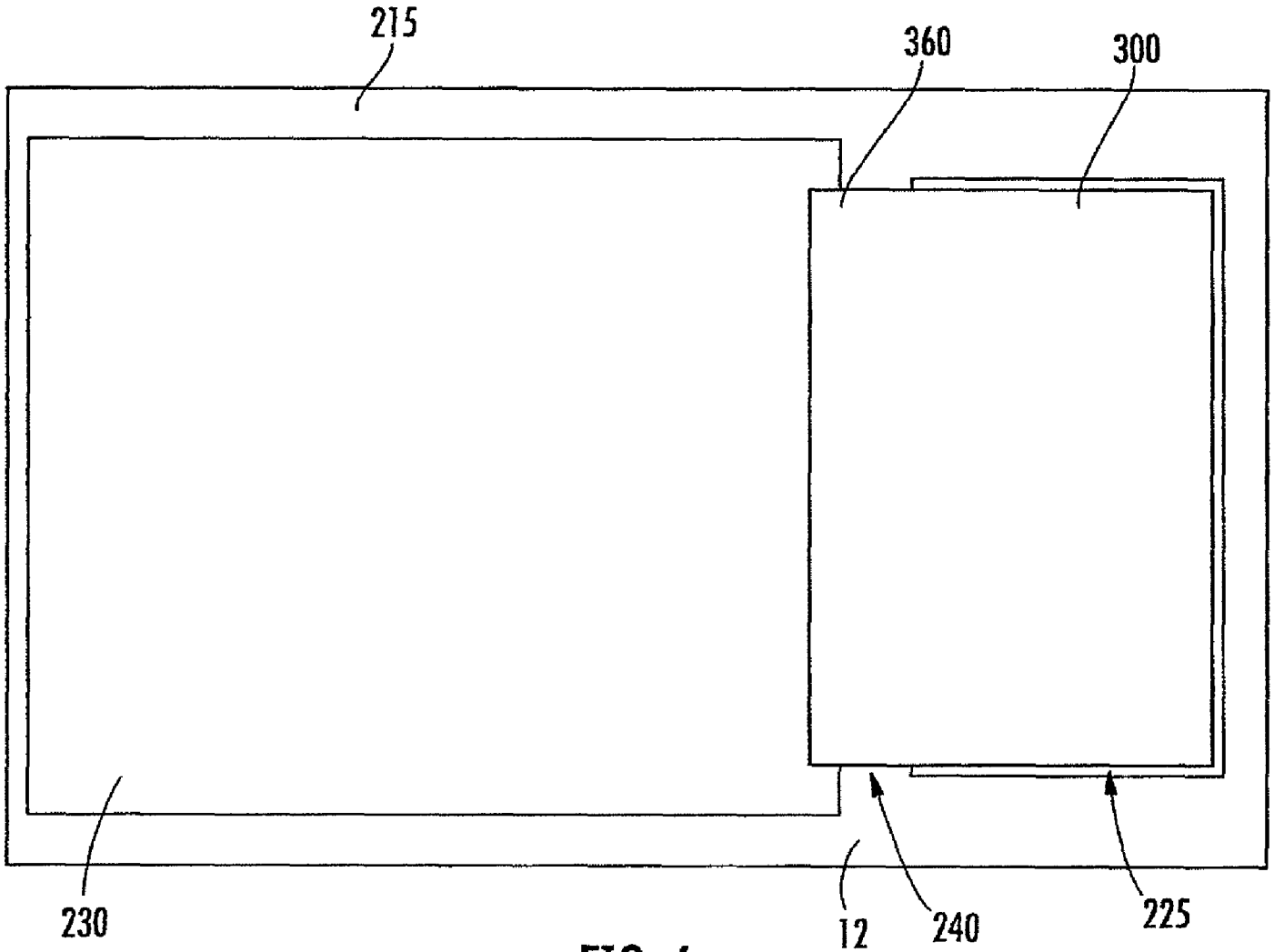

FIG. 5*a* is a top view of a die box consistent with an exemplary embodiment;

FIG. 5*b* is a top view of the die box of FIG. 5*a* modified through the use of two inserts; and FIG. 6 is a top view of a second package placed into a first compartment of a formed support member of a first package.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

DEFINITIONS

While the following terms are believed to be well understood by one of ordinary skill in the art, the following definitions are set forth to facilitate explanation of the presently disclosed subject matter.

Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a package" (e.g., "a marinade package") includes a plurality of such packages, and so forth.

Unless otherwise indicated, all numbers expressing quantities of components, reaction conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, percentage, and the like can encompass variations of, in some embodiments ±20%, in some embodiments ±10%, in some embodiments ±5%, in some embodiments ±1%, in some embodiments ±0.5%, and in some embodiments ±0.1%, from the specified amount, as such variations are appropriate in the disclosed package and methods.

As used herein, the phrase "abuse layer" refers to an outer film layer and/or an inner film layer, so long as the film layer serves to resist abrasion, puncture, and other potential causes of reduction of package integrity, as well as potential causes of reduction of package appearance quality. Abuse layers can comprise any polymer, so long as the polymer contributes to achieving an integrity goal and/or an appearance goal. In some embodiments, an abuse layer can comprise polymers having a modulus of at least $10^7$ Pascals, at room temperature. In some embodiments, an abuse layer can comprise, but is not limited to, polyamide and/or ethylene/propylene copolymer; in some embodiments, nylon 6, nylon 6/6, and/or amorphous nylon.

As used herein, the term "barrier", and the phrase "barrier layer", as applied to films and/or layers, can be used with reference to the ability of a film or layer to serve as a barrier to one or more gases. In the packaging art, oxygen (i.e., gaseous $0_2$) barrier layers have included, for example, ethylene/vinyl alcohol copolymer (polymerized ethylene vinyl alcohol), polyvinyl chloride, polyvinylidene chloride (PVDC), polyalkylene carbonate, polyamide, polyethylene naphthalate, polyester, polyacrylonitrile, and the like, as known to those of ordinary skill in the art. In some embodiments, the $0_2$-barrier layer can comprise ethylene/vinyl alcohol copolymer, polyvinyl chloride, polyvinylidene chloride, and/or polyamide.

As used herein, the terms "corona treatment" and "corona discharge treatment" refer to subjecting the surfaces of thermoplastic materials, such as polyolefins, to corona discharge, i.e., the ionization of a gas such as air in close proximity to a film surface, the ionization initiated by a high voltage passed through a nearby electrode, and causing oxidation and other changes to the film surface, such as surface roughness. Corona treatment of polymeric materials is disclosed in U.S. Pat. No. 4,120,716, to Bonet, herein incorporated in its entirety by reference thereto. U.S. Pat. No. 4,879,430, to Hoffman, also hereby incorporated in its entirety by reference thereto, discloses the use of corona discharge for the treatment of plastic webs for use in meat cook-in packaging, with the corona treatment of the inside surface of the web to increase the adhesion of the meat to the proteinaceous material.

As used herein, the term "film" can be used in a generic sense to include plastic web, regardless of whether it is film or sheet.

As used herein, the term "food additive" refers to any liquid or solid material that results or can reasonably be expected to result, directly or indirectly, in its becoming a component or otherwise affecting the characteristics of any food product. In some embodiments, the food additive can, for example, be an agent having a distinct taste and/or flavor, such as a salt or any other taste or flavor potentiator or modifier. Examples of food additives include, but are not limited to, marinades and proteolytic enzymes. In addition, components that by themselves are not additives, such as vitamins, minerals, color additives, herbal additives (e.g., echinacea or St. John's Wort), antimicrobials, preservatives, and the like can be considered food additives.

As used herein, the term "food product" refers to any nourishing substance that is eaten or otherwise taken into the body to sustain life, provide energy, promote growth, and/or the like. For example, in some embodiments, food products can include, but are not limited to, meats, vegetables, fruits, starches, and combinations thereof. In some embodiments, food products can include individual food components or mixtures thereof.

As used herein, the term "heat seal" refers to any seal of a first region of a film surface to a second region of a film surface, wherein the seal is formed by heating the regions to at least their respective seal initiation temperatures. Heat-sealing is the process of joining two or more thermoplastic films or sheets by heating areas in contact with each other to the temperature at which fusion occurs, usually aided by pressure. In some embodiments, heat-sealing can be inclusive of thermal sealing, melt-bead sealing, impulse sealing, dielectric sealing, and/or ultrasonic sealing. The heating can be performed by any one or more of a wide variety of means, such as (but not limited to) a heated bar, hot wire, hot air, infrared radiation, ultrasonic sealing, and the like.

As used herein, the term "lamination", the term "laminate", and the phrase "laminated film", can refer to the process and resulting product made by bonding together two or more layers of film and/or other materials. Lamination can be accomplished by joining film layers with adhesives, joining with heat and pressure, spread coating, and/or extrusion coating. In some embodiments, the term "laminate" can be inclusive of coextruded multilayer films comprising one or more tie layers.

As used herein, the term "marinade" refers to an edible substance that can impart one or more flavors and/or textures to a food product. In some embodiments, the marinade can comprise acidic ingredients, such as vinegar, lemon juice, and/or wine. In some embodiments, the marinade can comprise savory ingredients, such as soy sauce, brine, or other prepared sauces. In some embodiments, the marinade can comprise oils, herbs, and spices to further flavor a food item. In some embodiments, the marinade can comprise one or more proteolytic enzymes to flavor the food and/or to tenderize a food product.

As used herein, the term "meat" comprises both cooked and uncooked meat and includes, but is not limited to, beef, birds such as poultry (including chicken, duck, goose, turkey, and the like), buffalo, camel, crustacean (including shellfish, clams, scallops, mussels, oysters, lobster, crayfish, crab, shrimp, prawns, and the like), dog, fish (including salmon, trout, eel, cod, herring, plaice, whiting, halibut, turbot, ling, squid, tuna, sardines, swordfish, dogfish, shark, and the like), game (including deer, eland, antelope, and the like), game birds (such as pigeon, quail, doves, and the like), goat, hare, horse, kangaroo, lamb, marine mammals (including whales and the like), amphibians (including frogs and the like), monkey, pig, rabbit, reptiles (including turtles, snakes, alligators, and the like), and/or sheep.

As used herein, the term "oriented" refers to a polymer-containing material that has been stretched at an elevated temperature (the orientation temperature), followed by being "set" in the stretched configuration by cooling the material while substantially retaining the stretched dimensions. Upon subsequently heating unrestrained, unannealed, oriented polymer-containing material to its orientation temperature, heat shrinkage is produced almost to the original unstretched, i.e., pre-oriented dimensions. More particularly, the term "oriented", as used herein, can refer to oriented films, wherein the orientation can be produced in one or more of a variety of manners.

As used herein, the term "package" refers to packaging materials configured around a product being packaged, and can include (but are not limited to) bags, pouches, trays, and the like.

As used herein, the term "polymer" refers to the product of a polymerization reaction, and can be inclusive of homopolymers, copolymers, terpolymers, etc. In some embodiments, the layers of a film can consist essentially of a single polymer, or can have still additional polymers together therewith, i.e., blended therewith.

As used herein, the term "proteolytic enzyme" refers to an enzyme that can be added to a marinade fluid to sever peptide bonds in proteins, and therefore tenderize a meat. Proteolytic enzymes suitable for use with the presently disclosed subject matter can include, but are not limited to, bromelain from pineapple and papain from papaya, achromopeptidase, aminopeptidase, ancrod, angiotensin converting enzyme, bromelain, calpain, calpain I, calpain II, carboxypeptidase A, carboxypeptidase B, carboxypeptidase G, carboxypeptidase P, carboxypeptidase W, carboxypeptidase Y, caspase, caspase 1, caspase 2, caspase 3, caspase 4, caspase 5, caspase 6, caspase 7, caspase 8, caspase 9, caspase 10, caspase 11, caspase 12, caspase 13, cathepsin B, cathepsin C, cathepsin D, cathepsin G, cathepsin H, cathepsin L, chymopapain, chymase, chymotrypsin a-, clostripain, collagenase, complement Clr, complement Cls, complement Factor D, complement Factor I, cucumisin, dipeptidyl peptidase IV, elastase (leukocyte), elastase (pancreatic), endoproteinase Arg-C, endoproteinase Asp-N, endoproteinase Glu-C, endoproteinase Lys-C, enterokinase, factor Xa, ficin, furin, granzyme A, granzyme B, HIV protease, IGase, kallikrein tissue, leucine aminopeptidase (general), leucine aminopeptidase (cytosol), leucine aminopeptidase (microsomal), matrix metalloprotease, methionine amiopeptidase, neutrase, papain, pepsin, plasmin, prolidase, pronase E, prostate specific antigen, protease (alkalophilic form), *Streptomyces griseus*, protease from *Aspergillus*, protease from *Aspergillus saitoi*, protease from *Aspergillus sojae*, protease (*B. licheniformis*) (Alkaline), protease (*B. licheniformis*) (Alcalase), protease from *Bacillus polymyxa*, protease from *Bacillus* sp, protease from *Bacillus* sp (*Esperase*), protease from *Rhizopus* sp., protease S, proteasomes, proteinase from *Aspergillus oryzae*, proteinase 3, proteinase A, proteinase K, protein C, pyroglutamate amiopeptidase, renin, rennin, streptokinase, subtilisin, thermolysin, thrombin, tissue plasminogen activator, trypsin, tryptase, urokinase, and combinations thereof.

As used herein, the term "rupturable" with regard to a seal can indicate the susceptibility of being broken without implying weakness. Thus, in referring to a rupturable seal between the films of a package, it can be meant that when so sealed the films are united together in a fluid impervious manner, and when the seal is broken or severed by delamination of the films from one another in the area of the seal, the films are separated apart from one another severing the seal while still maintaining the integrity of the individual films themselves. Thus, the rupturable seal in an intact state serves to maintain the integrity of the product chamber reservoir for maintaining fluid, semi-fluid, and/or solid products therein but in a broken or severed state allows for passage of these products between the films along a delaminated seal area.

As used herein, the term "seal" refers to any seal of a first region of an outer film surface to a second region of an outer film surface, including heat or any type of adhesive material, thermal or otherwise. In some embodiments, the seal can be formed by heating the regions to at least their respective seal initiation temperatures. The sealing can be performed by any one or more of a wide variety of means, including, but not limited to, using a heat seal technique (e.g., melt-bead sealing, thermal sealing, impulse sealing, dielectric sealing, radio frequency sealing, ultrasonic sealing, hot air, hot wire, infrared radiation, etc.).

As used herein, the phrases "seal layer", "sealing layer", "heat seal layer", and "sealant layer", refer to an outer film layer, or layers, involved in the sealing of the film to itself, another film layer of the same or another film, and/or another article that is not a film. It should also be recognized that in general, up to the outer 3 mils of a film can be involved in the sealing of the film to itself or another layer. With respect to packages having only fin-type seals, as opposed to lap-type seals, the phrase "sealant layer" generally refers to the inside film layer of a package, as well as supporting layers adjacent this sealant layer often being sealed to itself, and frequently serving as a food contact layer in the packaging of foods. In general, a sealant layer sealed by heat-sealing layer comprises any thermoplastic polymer. In some embodiments, the heat-sealing layer can comprise, for example, thermoplastic polyolefin, thermoplastic polyamide, thermoplastic polyester, and thermoplastic polyvinyl chloride. In some embodiments, the heat-sealing layer can comprise thermoplastic polyolefin.

As used herein, the phrase "thermoforming layer" refers to a film layer that can be heated and drawn into a cavity while maintaining uniform thinning, as opposed to films or film layers that lose integrity during the thermoforming process (e.g., polyethylene homopolymers do not undergo thermoforming with uniform thinning). In some embodiments, thermoforming layers can comprise, but are not limited to, polyamide, ethylene/propylene copolymer, and/or propylene homopolymer; in some embodiments, nylon 6, nylon 6/6, amorphous nylon, ethylene/propylene copolymer, and/or propylene homopolymer.

As used herein, the term "thermoplastic" refers to uncrosslinked polymers of a thermally sensitive material that flow under the application of heat or pressure.

As used herein, the term "tie layer" refers to any internal layer having the primary purpose of adhering two layers to one another. In some embodiments, tie layers can comprise any nonpolar polymer having a polar group grafted thereon, such that the polymer is capable of covalent bonding to polar polymers such as polyamide and ethylene/vinyl alcohol copolymer. In some embodiments, tie layers can comprise at least one member selected from the group including, but not limited to, modified polyolefin, modified ethylene/vinyl acetate copolymer, and/or homogeneous ethylene/alpha-olefin copolymer. In some embodiments, tie layers can comprise at least one member selected from the group consisting of anhydride modified grafted linear low density polyethylene, anhydride grafted low density polyethylene, homogeneous ethylene/alpha-olefin copolymer, and/or anhydride grafted ethylene/vinyl acetate copolymer.

As used herein, terminology employing a "/" with respect to the chemical identity of a copolymer (e.g., "an ethylene/alpha-olefin copolymer"), identifies the comonomers that are copolymerized to produce the copolymer. Such phrases as "ethylene alpha-olefin copolymer" are the respective equivalent of "ethylene/alphaolefin copolymer."

General Overview

Figure 1:
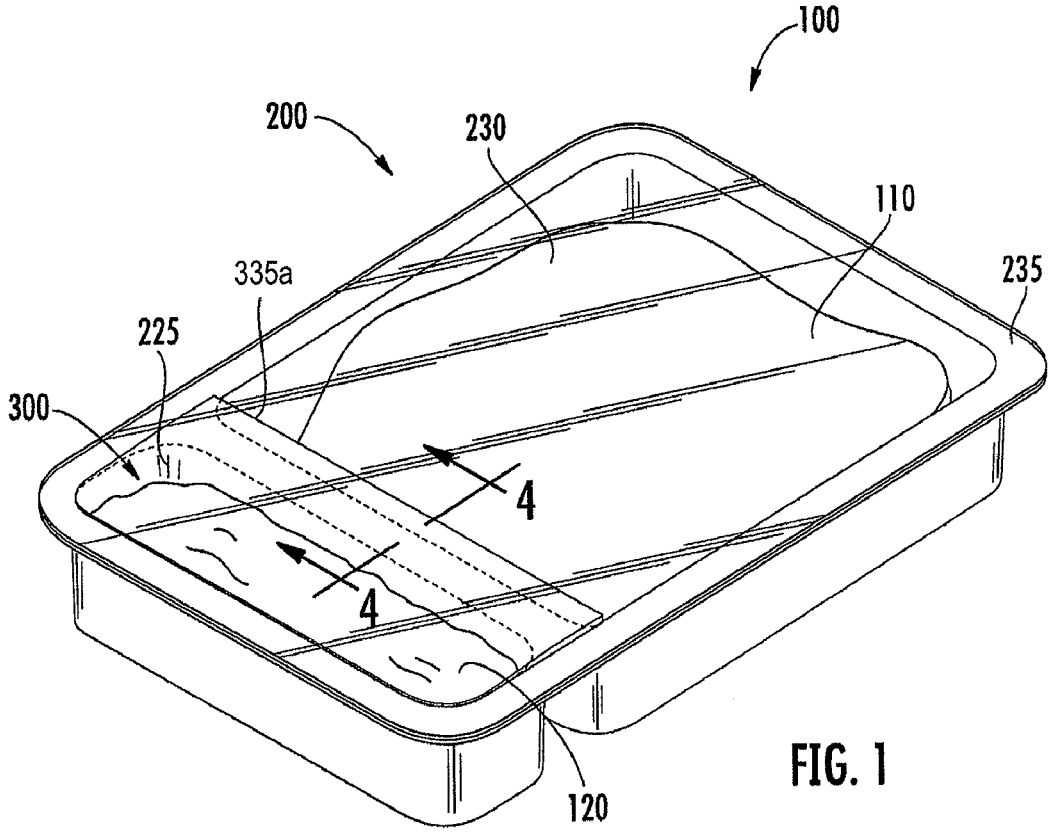
FIG. 1 is a perspective view of a package assembly for on-demand marination according to an exemplary embodiment.

FIG. 1 illustrates a package assembly 100 consistent with an exemplary embodiment of the present invention. The package assembly 100 contains at least a first package 200 and a second package 300. The first package 200 may contain two or more compartments. A first compartment 225 may substantially contain the second package 300 and a second compartment 230 may substantially contain one or more food products 110, such as a meat. The second package 300 may contain one or more food additives 120, such as a marinade. Although the second package 300 is substantially contained in the first compartment 225 of the first package, the second package 300 may include a rupturable seal 335*a* located proximate the second compartment 230. As explained in more detail further below, applying pressure to at least the first compartment 225 and, thus, the second package 300 may break the rupturable seal 335*a* to distribute the food additive 120 from the second package 300 to the food product 110 in the second compartment 230 of the first package. The first package 200 may include a perimeter hard seal 235 configured to withstand the applied pressure and, thus, prevent the leaking of any of the food product 110 or the food additive 120 from the first package during the distribution of the food additive 120. Thus, the presently disclosed subject matter achieves, among other things, controlled application of a food additive to a food product within a package assembly 100.

After sufficient marinating time, the marinated food product can be removed from package assembly and heated and/or cooked in an oven or microwave.

Exemplary Embodiments of First Package

Figure 2:
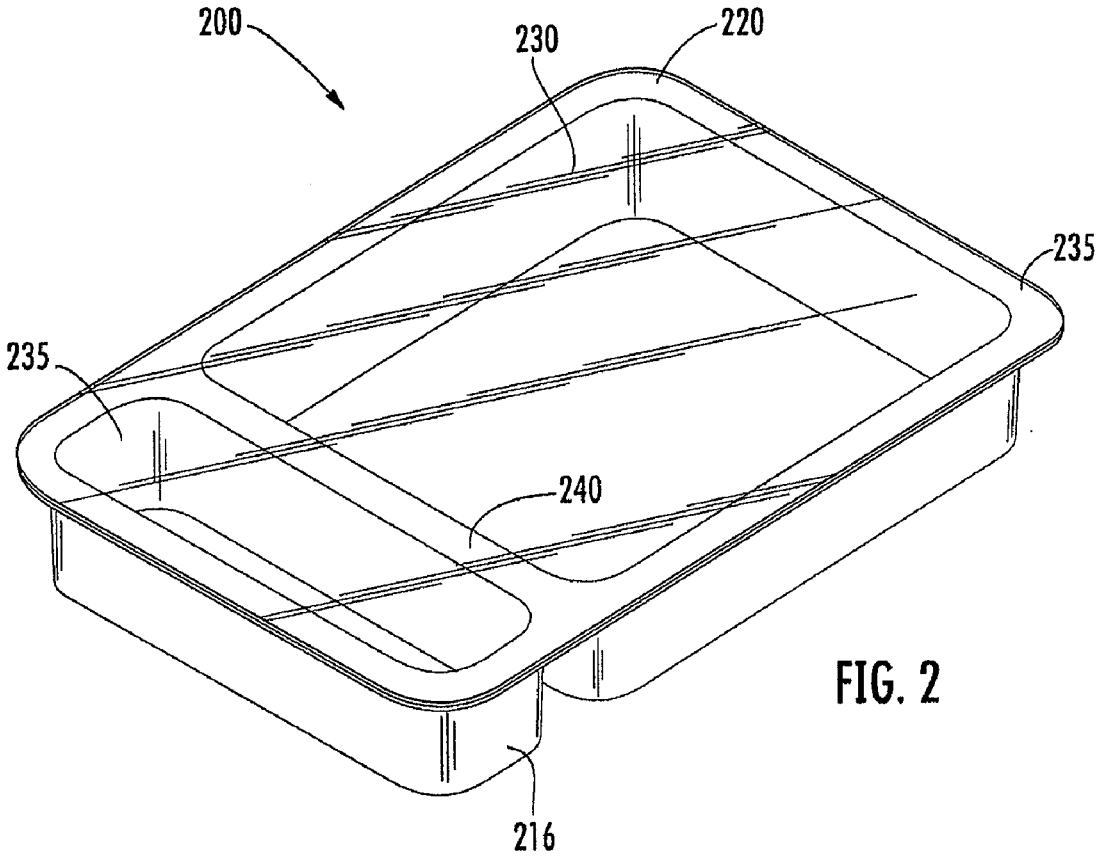
FIG. 2 is a is a perspective view of a first package of the package assembly of FIG. 1 without the second package having a food additive or a food product.

FIG. 2 illustrates an example of a first package 200 without the second package, any food additives or food products. The first package 200 can be fabricated from a first film 215 that is extruded and thermoformed to produce the first compartment 225 and the second compartment 230. In the illustrated embodiment, the first and second compartments are separated from another by a partition 240 defined by two inner walls of the compartments 225 and 230. Although two compartments are illustrated in FIG. 2, one of ordinary skill in the art would recognize that the presently disclosed subject matter can include package configurations with more than two compartments. A second thermoplastic film 220 can be hermetically sealed to first thermoplastic film 215 through a perimeter seal 235 such that the compartmented first package 200 is substantially air and liquid tight. The perimeter seal 235 extends around the perimeter of first package 200 to create an airtight container. In some embodiments, e.g., the illustrated embodiment, the first film 215 and/or the second film 220 can be transparent so that the contents of the first package can be viewed.

The first package may be include a secondary seal (not illustrated) to provide additional strength to one or more compartments of the first package as further disclosed in U.S. patent application Ser. No. 12/079,409 filed on Mar. 26, 2008 (entitled "On-Demand Meat Tenderizing Package"; and assigned to the assignee of the present application, the entire disclosure of which is hereby incorporated herein by reference.

Referring back to the perimeter seal 235, as illustrated in FIG. 1 the perimeter seal 235 can be used to reliably contain the second package 300 containing the food additive and the food product in their respective compartments at normal operating pressures before, during, and after marinating. The perimeter seal 235 can also provide a margin of safety to contain the contents of the first package 200 in the event that the first package is dropped, bumped, and/or otherwise transiently exposed to higher pressures either before the rupturable seal 335*a* of the second package is broken or afterwards.

Moreover, the perimeter seal 235 (and/or, in embodiments having a secondary seal, the secondary seal) can be configured to be a hard or permanent seal in that the strength of the seal is intended to be strong enough to prevent rupture or the strength of the seal is intended to be equal to or higher than the strength of the sealed plastic films 215 and 220.

FIGS. 1 and 2 illustrate that the first package 200 can be closed on all four edges. In some embodiments, one or more of the edges can comprise sealed edges. For example, in embodiments in which the first package is formed from two separate sheets of plastic film, the four edges may all be sealed edges. Thus, the first package 200 may be formed by heat sealing films 215 and 220 to form a package containing a second package and a food product in the first and second compartments 225 and 230. In some embodiments, the heat sealing operation can occur at the food packaging plant using a heat sealing machine designed for high speed operation. Heat sealing can occur by any of a number of techniques well known in the art, such as but not limited to, thermal conductance heat sealing, impulse sealing, ultrasonic sealing, dielectric sealing, and/or combinations thereof.

In some embodiments, the heat sealing machine includes a heated seal bar that contacts and compresses the two films to be heat sealed together to form the perimeter seal 235. Generally, three variables can be considered in forming a heat seal: the seal bar temperature, the dwell time, and the sealing pressure. The seal bar temperature can refer to the surface temperature of the seal bar. The dwell time can refer to the length of time that the heated seal bar contacts the film to transfer heat from the seal bar to soften at least a portion of the films (e.g., the sealing layers of the films) so that they can be melded together. The sealing pressure can refer to the amount of force that squeezes the films together during this heat transfer. All of these variables can be modified accordingly in order to prepare a package suitable with the presently disclosed subject matter.

Because the heat sealing layers for much of the thermoplastic packaging films used in food packaging are based on relatively low-melting polyolefin thermoplastics (or similar melt-temperature thermoplastics), the heat sealing machines present in food packaging plants can be designed and set to operate with a seal bar temperature, a dwell time, and a sealing pressure in a range useful for such materials to permit the heat sealing machines to operate at high speeds to form strong seals.

Although the films of presently disclosed package 200 may be heat-sealed to form perimeter seal 235, the use of other adhesives or mechanical closures (e.g., clips) as desired or necessary is within the scope of the presently disclosed subject matter. Particularly, adhesives can be applied in a desired pattern, or sealed at a certain temperature (such as with a layer of ionomer) to define seal strength in a directly proportional fashion; i.e., more adhesive or higher temperature can create a stronger seal, while less adhesive or lower temperature can produce a weaker seal.

In some embodiments, the perimeter seal 235 may not be sealed until after the first package 200 is filled. For example, the first film 215 is formed into a compartmented support member having at least two compartments adapted to contain a second package and a food product. The compartmented support member is then loaded with a second package containing the food additive and the food product. The second film 220 can be positioned to contact the first film 215 at least along the perimeter of the first package. A vacuum can then be applied to the compartments. The second film 220 can then be sealed around the perimeter of the compartmented support member to form the perimeter seal 235 in this regard the second film 220 can function as a cover to the support member.

Exemplary Embodiments of Second Package

Figure 3:
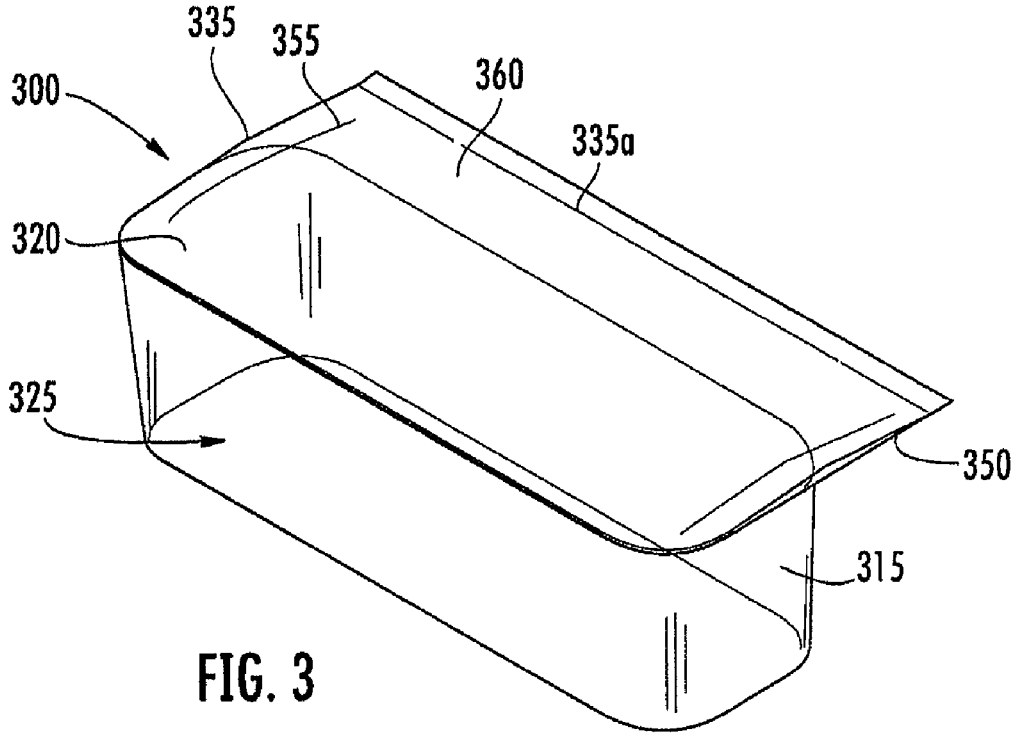
FIG. 3 is a perspective view of a second package of the package assembly of FIG. 1 without a food additive.

FIG. 3 illustrates an example of a second package 300 without any food additives. The second package 300 can be fabricated similar to the first package 200 as described in the above exemplary embodiment in that two films may be sealed together along four edges to form a package. Alternatively, the second package can include a first film that is folded unto itself such that the fold in the first film forms an edge of the package and the remaining edges may be sealed together. In the illustrated embodiment, the second package 300 can be fabricated from the first film 315 that is extruded and thermoformed to produce a compartment 325 and a first part 350 of a flange extending away from the compartment 325. The second film 320 can be hermetically sealed to first thermoplastic film 315 through a perimeter seal 335 such that the compartment 325 is substantially air and liquid tight. The perimeter seal 335 extends substantially around the perimeter of the second package 300 to create an airtight container. The second film 320 may also define a second part 355 of the flange that corresponds to the first part 350. The perimeter seal 335 or another seal may be used to seal the first and second parts 350 and 355 together and the sealed first and second parts define a flange 360 of the second package. In some embodiments, e.g., the illustrated embodiment, the first film 315 and the second film 320 can be transparent so that the contents of the second package 300 can be viewed. The second package 300 or, more particularly, the compartment 325 of the second package 300 may be configured to substantially fit into and, thus, be contained in the first compartment 225 of first package 200. Therefore, the second package 300 can be adapted to be slightly smaller than the first compartment of the first package 200.

FIGS. 1 and 3 illustrate that the second package 300 can be closed on all four edges. In some embodiments, one or more of the edges can comprise sealed edges. For example, in embodiments in which the second package is formed from two separate sheets of plastic film, the four edges may all be sealed edges. Thus, the second package 300 can be formed by heat sealing the two films 315 and 320 to form an airtight container. In some embodiments, the heat sealing operation can occur at the food packaging plant (however, not necessarily at the same food packaging plant as for the first package) using a heat sealing machine designed for high speed operation. Heat sealing can occur by any of a number of techniques well known in the art, such as but not limited to, thermal conductance heat sealing, impulse sealing, ultrasonic sealing, dielectric sealing, and/or combinations thereof.

In some embodiments, the heat sealing machine includes a heated seal bar that contacts and compresses the two films to be heat sealed together to form the perimeter seal 335. Generally, three variables can be considered in forming a heat seal: the seal bar temperature, the dwell time, and the sealing pressure. The seal bar temperature can refer to the surface temperature of the seal bar. The dwell time can refer to the length of time that the heated seal bar contacts the film to transfer heat from the seal bar to soften at least a portion of the films (e.g., the sealing layers of the films) so that they can be melded together. The sealing pressure can refer to the amount of force that squeezes the films together during this heat transfer. All of these variables can be modified accordingly in order to prepare a package suitable with the presently disclosed subject matter.

Because the heat sealing layers for much of the thermoplastic packaging films used in food packaging are based on relatively low-melting polyolefin thermoplastics (or similar melt-temperature thermoplastics), the heat sealing machines present in food packaging plants can be designed and set to operate with a seal bar temperature, a dwell time, and a sealing pressure in a range useful for such materials to permit the heat sealing machines to operate at high speeds to form strong seals.

Although the films of the second package 300 may be heat-sealed to form the perimeter seal 335, the use of other adhesives or mechanical closures (e.g., clips) as desired or necessary is within the scope of the presently disclosed subject matter. Particularly, adhesives can be applied in a desired pattern, or sealed at a certain temperature (such as with a layer of ionomer) to define seal strength in a directly proportional fashion; i.e., more adhesive or higher temperature can create a stronger seal, while less adhesive or lower temperature can produce a weaker seal.

In some embodiments, the perimeter seal 335 may not be sealed until after the second package 300 is filled. For example, the first film 315 can be formed into a support member having a compartment 325 adapted to contain a food additive and a defining a first part 350 of a flange. The compartment 325 may then be loaded with a food additive. Next, the second film 320 can be positioned to contact the first film 315, at least, along the perimeter of the second package. A vacuum can then be applied to the compartment 325. The second film 320 can then be sealed around the perimeter of the support member to form perimeter seal 335. In this regard, the second film 320 can function as a cover that is sealed to the support member.

The filling of the food additive into the second package and the sealing of the second package may incur before or after the second package is placed into the first compartment of the first package. For example, the filing and sealing operations of the second package may incur before the introduction of the first package. Indeed, the filing and sealing operations may incur at a different location or even facility than the forming and sealing of the first package. Such an embodiment may reduce the likelihood of cross-contamination of the food additive and the food product.

Referring back to the perimeter seal 335 of the second package, the perimeter seal 335 or one or more portions thereof may be designed to break when exposed to a predetermined pressure, referred to as being rupturable. In general, the rupturable perimeter seal 335 of the second package is particularly configured to have a lower rupture pressure compared to perimeter hard seal 235 (and, in embodiments having a secondary seal, the secondary seal) of the first package such that the seal(s) of the first package is unaffected by the rupture of perimeter seal 335 of the second package. In addition, perimeter seal 335 may be configured to rupture in a controlled manner across a sufficient area to provide a relatively low-pressure movement of a flowable food additive (such as marinade) out of the compartment 325 of the second package.

Although the entire perimeter seal of the second package may be configured to rupture, in other embodiments, the perimeter seal may have only a portion that is configured to rupture, e.g., the portion extending across the flange or, more specifically, the second package may include a first permanent seal that extends around the perimeter except for the portion extending across the flange and a second rupturable seal that extends across the flange. In such an embodiment, when pressure is applied, the second rupturable seal is intended to rupture before the first permanent seal and, thus, the food additives would escape through the flange only.

A rupturable seal can be formed by any of a number of various techniques known in the art. Particularly, it will be understood that there are a number of ways of making a rupturable seal in accordance with the presently disclosed subject matter, including, but not limited to, one or more of zone patterning, adhesive, ultrasonic welding, thermal bonding, crimping, cohesives, compression, nipping, needle punching, sewing, hydroentangling, and the like. For example, in some embodiments, rupturable seal can be formed of a pattern of printed ink that prevents the package films from heat sealing at an inked portion, such that the amount of inked portions in the ink pattern determine the strength of the seal. In some embodiments, rupturable seal can be fabricated by means of a discontinuity within the seal width. For example, one discontinuity within rupturable seal can include one or more stress concentrators having an inflection point that is more responsive to the interior bag pressure force than other portions that are relatively straight or smoothly curved.

Continuing, in some embodiments, a rupturable seal can be comprised of incompatible polymer blends. For example, each of the films 315 and 320 can be fabricated from an extrusion molding process in which two or more thermoplastic materials or polymer blends are melted and extruded together. One or more of the thermoplastic materials may be incompatible to each other such that the addition of the one or more of the thermoplastic materials increases the resistance of the two films 315 and 320 to seal together due to the incompatible materials in the films 315 and 320. Thus, the seal strengths of rupturable seal can depend on the particular polymer blend used. For example, common polymer blends can include, but are not limited to, zinc neutralized ethylene-acid (EMAA or EAA) copolymer ionomer (e.g., Surlyn 1650) with ethylene vinyl acetate (EVA) copolymer (e.g., Elvax 3120) and optionally with or without polybutylene; polypropylene with ethylene vinyl acetate; sodium neutralized EMAA, EMAA, and/or EVA; EVA and polystyrene or polystyrene copolymer (e.g., K-Resin® or Styralux®); and/or EVA with polybutylene. In some embodiments, the EVA can be replaced with other polyethylenes, as would be apparent to one of ordinary skill in the art.

In some embodiments, the strength of a rupturable seal can be manipulated by the temperature, dwell time and/or pressure of the heat seal bar, depending on the type and thickness of the sealant being applied. It is to be understood that the pressure required to a separate rupturable seal can depend upon the width of the sealed area at the inner end thereof. Thus, the size and configuration of rupturable seal can be altered to vary the pressure within the sealed enclosure required to rupture the seal.

Exemplary Embodiments of Package Assembly

Figure 4:
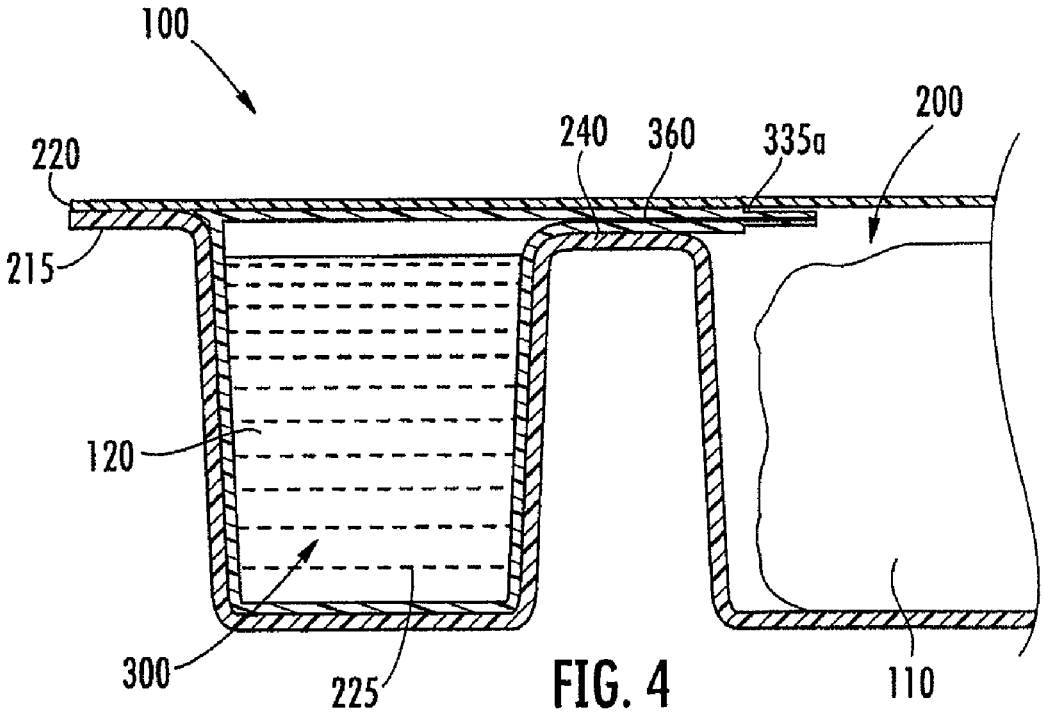
FIG. 4 is a cross-section view of FIG. 1 taken along line 4-4.

Referring back to FIG. 1 and referring to FIG. 4, the second package 300 is substantially contained in the first compartment 225 of the first package 200. The flange 360 of the second package extends from the first compartment 225 of the first package toward the second compartment 230 of the first package. More specifically, the flange 360 extends from the first compartment 225 at least partially across the partition 240 separating the first and second compartments 225 and 230 into the second compartment 230 such that the second package 300 is in fluid communication with the second compartment 230 when the rupturable seal 335*a* across the flange 360 ruptures. For example, when pressure is applied to the second package 300 and the rupturable seal 335*a* across the flange 360 ruptures, the food additive 120 in the second package 300 may leave the second package 300 via the flange 360 into the second compartment 230 and interact with the food product 120 contained in the second compartment 230. Even as pressure is applied to the second package 300 through the first package 200, the perimeter hard seal 235 of the first package is configured to prevent any of the food additive 120 or food product 110 from leaking out of the first package 200.

Exemplary Embodiments of Methods to Manufacture the Package Assembly

As discussed above, one or more of the first package and the second package can be manufactured through an extrusion molding and thermoform molding process. As a more specific example, the first package 200 can be fabricated from the first film 215 that is extruded and thermoformed to produce the first compartment 225 and the second compartment 230. Extrusion molding is well known plastic shaping processing in which, e.g., thermoplastic material are fed from a hopper or other device into an extruder configured to heat the thermoplastic material and force it through a die to form and particular profile such as a plastic film or sheet. Thermoforming is well known in the packaging art, and is the process whereby a thermoplastic web is heat softened and reshaped to conform to the shape of a cavity in a mold. Suitable thermoforming methods, for example, include a vacuum forming or plug-assist vacuum forming method. In a vacuum forming method, the first web is heated, for example, by a contact heater, and a vacuum is applied beneath the web causing the web to be pushed by atmospheric pressure down into a preformed mold. In a plug-assist vacuum forming method, after the first or forming web has been heated and sealed across a mold cavity, a plug shape similar to the mold shape impinges on the forming web and, upon the application of vacuum, the forming web transfers to the mold surface.

It should be noted herein that the first film 215 of the first package may be considered a "bottom" web, e.g., in normal usage, the first package can rest on the first film 215 such that the web comprises the bottom of first package 200. Likewise, the second film 200 may be considered a "top" web, e.g., in normal usage, the first package can be positioned such that the web of the second film comprises the top of the first package that covers the bottom web. This description is for convenience in understanding the presently disclosed subject matter. Nevertheless, those skilled in the art will understand, after a review of the presently disclosed subject matter, that the first package may be manufactured, stored, shipped, and/or displayed in any suitable orientation. For example, the first package may be placed on a supporting surface such that the thermoformed web functions as the top of the package and the covering web functions as the bottom of the package.

In some embodiments, the first and second films 215 and 220 of the first package, respectively, may be multilayered structures having various layers that are produced using coextrusion techniques and lamination techniques well known in the art. Thus, the films can be coextruded or laminated and can be adhered together with a coextruded tie layer such as ethylene vinyl acetate, an ionomer, anhydride grafted ethylene vinyl acetate, low density polyethylene and/or linear low density polyethylene. The typical film-to-film bond from lamination may be made by adhering the films together with a thin layer of polyurethane coating on an adhesive laminator. The lamination can also be accomplished by extrusion lamination or extrusion coating with an adhesive coextrusion tie layer type resin at the bond interface. Thus, films of the presently disclosed subject matter can be manufactured by coextrusion methods and adhesive lamination methods, such as those disclosed in U.S. Pat. No. 6,769,227 to Mumpower, the content of which is incorporated herein in its entirety by reference thereto. Accordingly, films of the presently disclosed subject matter can be made by any suitable process, including coextrusion, lamination, extrusion coating, and combinations thereof.

The films used to form the disclosed packages can be provided in sheet or film form and can be any of the films commonly used for this type of packaging. In some embodiments, however, the film can be a commercially available multilayer film having a sealant layer, a barrier layer, and one or more abuse layers.

Thus, in some embodiments, the first and second films of the first package may comprise one or more barrier layers. Such barrier layers can include, but are not limited to, ethylene/vinyl alcohol copolymer, polyvinylidene chloride, polyalkylene carbonate, polyamide, polyethylene naphthalate, polyester, polyacrylonitrile, and combinations thereof, as known to those of skill in the art. In some embodiments, the barrier layer can comprise either EVOH or polyvinylidene chloride, and the PVDC can comprise a thermal stabilizer (i.e., a HCl scavenger, such as epoxidized soybean oil) and/or a lubricating and/or processing aid, which are well known in the art.

In some embodiments, the first and second films of the first package may comprise one or more seal layers. Such seal layers can include, but are not limited to, the genus of thermoplastic polymers, including thermoplastic polyolefin, polyamide, polyester, polyvinyl chloride, homogeneous ethylene/alpha-olefin copolymer, ethylene/vinyl acetate copolymer, ionomer, and combinations thereof.

In some embodiments, the first and second films of the first package may comprise one or more tie layers. In some embodiments, tie layers can comprise any nonpolar polymer having a polar group grafted thereon, so that the polymer is capable of covalent bonding to polar polymers, such as polyamide and ethylene/vinyl alcohol copolymer. In some embodiments, tie layers can comprise at least one member of the group including, but not limited to, modified polyolefin, modified ethylene/vinyl acetate copolymer, homogeneous ethylene/alpha-olefin copolymer, and combinations thereof. In some embodiments, tie layers can comprise at least one member selected from the group including, but not limited to, anhydride modified grafted linear low density polyethylene, anhydride grafted low density polyethylene, homogeneous ethylene/alpha-olefin copolymer, and/or anhydride grafted ethylene/vinyl acetate copolymer.

In some embodiments, the first and second films of the first package may comprise one or more abuse layers. In some embodiments, abuse layers can comprise any polymer, so long as the polymer contributes to achieving an integrity goal and/or an appearance goal. In some embodiments, the abuse layer can include, but is not limited to, polyamide, ethylene/propylene copolymer, nylon 6, nylon 6/6, amorphous nylon, and combinations thereof.

In some embodiments, the first and second films of the first package may comprise one or more bulk layers to increase the abuse-resistance, toughness, modulus, etc., of the film. In some embodiments, the bulk layer can comprise polyolefin, including but not limited to, at least one member selected from the group consisting of ethylene/alphaolefin copolymer, ethylene/alpha-olefin copolymer plastomer, low density polyethylene, and linear low density polyethylene.

The polymer components used to fabricate the films according to the presently disclosed subject matter can also comprise appropriate amounts of other additives normally included in such compositions. For example, slip agents (such as talc), antioxidants, fillers, dyes, pigments and dyes, radiation stabilizers, antistatic agents, elastomers, and the like can be added to the disclosed films.

Generally, the films employed in the presently disclosed subject matter can be multilayer or monolayer, although, of course, those films defined as delaminatable, multilayer films must include at least two layers. Typically, the films employed will have two or more layers in order to incorporate a variety of properties, such as, for example, sealability, gas impermeability and toughness, into a single film.

In some embodiments, at least a portion of at least one film of the presently disclosed subject matter can be irradiated to induce cross-linking. In the irradiation process, the film is subjected to one or more energetic radiation treatments, such as corona discharge, plasma, flame, ultraviolet, X-ray, gamma ray, beta ray, and high energy electron treatment, each of which induces cross-linking between molecules of the irradiated material. The irradiation of polymeric films is disclosed in U.S. Pat. No. 4,064,296, to Bornstein et al., which is hereby incorporated in its entirety by reference thereto.

Films of the presently disclosed subject matter can have any total thickness desired, so long as the films provide the desired properties for the particular packaging operation in which the film is used. Final web thicknesses can vary, depending on process, end use application, and the like. Typical thicknesses range between 0.1 to 20 mils, in some embodiments between 0.3 and 15 mils, in some embodiments 0.5 to 10 mils, in some embodiments 1 to 8 mils, in some embodiments 3 to 6 mils, such as 4 to 5 mils. In some embodiments, top webs can have a thickness of between 2 and 5 mils, and bottom webs can have a thickness of between 5 and 10 mils.

In some embodiments, the film according to the presently disclosed subject matter comprises a total of from about 4 to about 20 layers; in some embodiments, from about 4 to about 12 layers; and in some embodiments, from about 5 to about 9 layers. Thus, in some embodiments, the disclosed film can comprise 1, 2, 3, 4, 5, 6, 7, 8, 9, 10, 11, 12, 13, 14, 15, 16, 17, 18, 19, or 20 layers. Accordingly, the film of the disclosed package can have any total thickness desired, so long as the film provides the desired properties for the particular packaging operation in which the film is used, e.g. optics, modulus, seal strength, and the like.

In some embodiments, first and second films of the first package may be transparent (at least in the non-printed regions) so that the packaged articles are visible through the films. "Transparent" as used herein means that the material transmits incident light with negligible scattering and little absorption, enabling objects (e.g., packaged food or print) to be seen clearly through the material under typical unaided viewing conditions (i.e., the expected use conditions of the material). The transparency (i.e., clarity) of the film can be at least about any of the following values: 20%, 25%, 30%, 40%, 50%, 65%, 70%, 75%, 80%, 85%, and 95%, as measured in accordance with ASTM D1746.

Although the forgoing description regarding the films being described as the bottom and top webs, the manufacturing of the films, the different layers within the film including, but not limited to, barrier layers, tie layers, abuse layers, and bulk layers, and the schematic of FIG. 7 as being applicable to the first package and its films, it will be evident to one skilled in the art that the foregoing description is equally applicable to the second package and its films.

With respect to the seals of the first and second packages, in some embodiments, the seals can be formed using a heat sealing machine that includes a heated seal bar that contacts and compresses films together to form a seal. In particular and as an example, regarding the perimeter hard seal 235 of the first package, after compression for a desired amount of time, the heating bar can then be removed to allow the sealed area to cool and form a sealed bond. The resulting perimeter seal 235 can extend continuously around the outside edge of package 200 to hermetically seal or enclose the food product and/or the second package and thus food additive housed therein. In this manner, first and second films 215 and 220 of the first package can form a substantially gas-impermeable enclosure to protect the food product and the second package from contact with the surrounding environment including atmospheric oxygen, dirt, dust, moisture, liquid, microbial contaminates, and the like. In some embodiments, the food product and the food additive contained in the second package can be packaged in a modified atmosphere package to extend the shelf life or bloom-color life.

The resulting perimeter seal 235 between first and second films 215 and 220 may be sufficiently strong to withstand the expected use conditions. For example, the bond strength of perimeter seal 235 can be at least about any of the following values: 7.0, 8.0, 9.0, and 10 pounds/inch or greater. The term "heat seal bond strength" as used herein can refer to the amount of force required to separate the second film 220 from first film 215, as measured in accordance with ASTM F88-94 where the Instron tensile tester crosshead speed is 5 inches per second, using five, 1-inch wide representative samples. As discussed above, the strength of the perimeter seal may be equal to or greater than the strength of the films themselves or otherwise be considered permanent or a hard seal.

The rupturable seal 335*a* of the second package may be formed by any of a number of various techniques. Particularly, it will be understood that the rupturable seal 335*a* can be made using one or more of incompatible materials, zone patterning, adhesive, ultrasonic welding, thermal bonding, crimping, cohesives, compression, nipping, needle punching, sewing, hydro-entangling, and the like. A combination of these methods can also be used. In general the rupturable seal 335*a* of the second package is configured to have a lower strength than the perimeter seal 235 of the first package and of any of the films of the second package. As an example, the strength of the rupturable seal 335*a* can be any of the following values 1.0, 2.0, 3.0. 4.0, 5.0, 6.0, 7.0, and 8.0 pounds/inch.

Referring back to the thermoforming processes, the processes may include a horizontal form, fill and seal machine, e.g., as partially shown in FIGS. 5*a*, 5*b* and 6. FIG. 5*a* illustrates a die box 500 for forming the compartmented support member of the first package. In particular the die box 500 includes a first cavity 510 for forming the first compartment and second cavity 520 for forming the second compartment. A sheet of film may be placed against the die box and the first and second compartments may be formed through a thermoforming process in which portions of the sheet of film are forced (through a plug and/or vacuum force) to assume the shape of the two cavities. The same die box 500 can be modified to form one or more second packages according to the exemplary embodiments described herein. For example, inserts may be used to modify the cavities to form compartments of the second packages rather than the first and second compartments of the first package. More specifically and as illustrated in FIG. 5*b*, a first insert 610 may be placed into the first cavity 510 such that the first insert 610 defines a modified first cavity 615 of the die box having a size slightly smaller than the unmodified first cavity 510. The intent of modifying the first cavity is to form a compartment of the second package that is slightly smaller than the first compartment of the first package and, thus, allow the compartment of the second package to fit into the first compartment. A second insert 620 may be placed into the second cavity 520. The second insert 620 defines two cavities, referred to as a second cavity 625 and a third cavity 630. Each of the second cavity 625 and third cavity 630 is substantially the same as the modified first cavity 615 such that each of the second cavity and the third cavity form substantially the same size compartment as the modified first cavity. With the placement of the inserts 610 and 620, a sheet of film may be placed against the die box 500 and three compartments may be formed through an extrusion process in which portions of the sheet of film are forced (through a plug and/or vacuum force) to assume the shape of the cavities. Once the compartments are formed, the food additives may be added to each of the compartments, a second sheet of film may be placed onto and sealed with the first sheet of film and compartments. A vacuum process may also be used to evacuate the atmosphere in the compartments prior to sealing the films together. Next, the first and second sealed films may be trimmed or cut to form three packages containing a food additive. The cutting operations may be used to define a flange of each package. As explained herein, the flange can be used as conduit between the first and second compartments of the first package. FIG. 6 illustrates the second package 300 placed in a first compartment 225 of a formed support member 215 of the first package. As illustrated, a flange 360 of the second package extends at least partially across the partition 240 separating the first and second compartments 225 and 230. A food product (not illustrated in FIG. 6) may be placed into the second compartment. After the second package and the food products are loaded into the first and second compartments respectively, a second sheet of film or a cover may be placed onto and sealed with the support member and its compartments. A vacuum process may also be used to evacuate the atmosphere in the compartments prior to sealing them. Next, if necessary, the second sealed film or cover may be trimmed or cut to correspond to the bottom support member of the first package.

In addition to the hard seal along the perimeter of the first package, a second seal and a third seal may be applied to the first package. For example, along the partition, a second seal may be applied between the first plastic film of the first package and the first plastic film of the second package that corresponds to the flange of the second package. Similarly, along the partition, a third seal may be applied between the second plastic film of the second package and the second plastic film of the second package that corresponds to the flange of the second package. The second and third seals can be either a hard seal or rupturable seal. The intent of the second and third seals is to prevent the food product from leaking from the second compartment to the first compartment prior to the rupturing of the rupturable seal of the second package.

Package Assembly Contents

As set forth in detail herein above, in some embodiments the second compartment 230 of the first package 200 may comprise a food product, such as a cut of meat. Examples of meat that are suitable for use with the presently disclosed subject matter can include, but are not limited to, beef, birds such as poultry (including chicken, duck, goose, turkey, and the like), buffalo, camel, crustacean (including shellfish, clams, scallops, mussels, oysters, lobster, crayfish, crab, shrimp, prawns, and the like), dog, fish (including salmon, trout, eel, cod, herring, plaice, whiting, halibut, turbot, ling, squid, tuna, sardines, swordfish, dogfish, shark, and the like), game (including deer, eland, antelope, and the like), game birds (such as pigeon, quail, doves, and the like), goat, hare, horse, kangaroo, lamb, marine mammals (including whales and the like), amphibians (including frogs and the like), monkey, pig, rabbit, reptiles (including turtles, snakes, alligators, and the like), and/or sheep. In some embodiments, the food product can be whole, diced, minced, shaved, cut into strips, and/or formed into meatballs.

In some embodiments, meat substitutes can be used and are included under the term "meat". Such meat substitutes can approximate the aesthetic qualities and/or chemical characteristics of certain types of meat. The meat substitutes can include, but are not limited to, seitan, rice, mushrooms, legumes, tempeh, textured vegetable protein, soy concentrate, mycoprotein-based Quorn, modified defatted peanut flour, and/or pressed tofu to make the meat substitute look and/or taste like chicken, beef, lamb, ham, sausage, seafood, and the like.

In some embodiments, the food product can comprise one or more vegetables. Vegetables that are particularly suited for use with the presently disclosed subject matter can include, but are not limited to, artichokes, asparagus, beans, bean sprouts, beets, broccoli, cauliflower, cabbage, carrots, celery, corn, collards, eggplant, green peppers, kale, leeks, mushrooms, mustard greens, onions, peas, potatoes, radishes, red peppers, rhubarb, spinach, squash, sweet potatoes, turnips, water chestnuts, watercress, yams, yellow peppers, and/or zucchini. In some embodiments, the vegetable can be diced, minced, shaved, and/or cut into strips.

Accordingly, the food product suitable for use with the presently disclosed subject matter is not particularly limited. The presently disclosed methods and package can be applied to raw (i.e., uncooked) food products, partially cooked food products, and/or pre-cooked products, where the cooking process is intended to cook, completely cook, and/or re-heat the food product. Thus, the food product selected can be any type that is suitable for consumption. The food product can be non-rendered, non-dried, raw, and can comprise mixtures of whole muscle meat formulations. Whole meat pieces can be fresh, although frozen or semi-frozen forms can also be used. Since freezing affects the tenderness of meat by rupturing intrafibrillar tissue as a result of ice crystal formation, the increased tenderness resulting from freezing can be taken into account when using such products in the package and methods described herein.

As set forth in detail herein above, in some embodiments, the first compartment 225 of the first package 200 can substantially contain a second package 300 which may house a food additive, such as marinade. The amount of marinade to be used in the presently disclosed subject matter depends on the type and added amount of food additive. The food additive can be in any form including, but not limited to, liquid, paste, powder, and/or combinations thereof. In some embodiments, the food additive can be in the form of liquid or powder from the standpoint of handleability, preservability, and the like. If the food additive of the presently disclosed subject matter is used in liquid form, it can be in the form of solution or dispersion in water or an aqueous liquid or in the form of solution or dispersion in fatty oil. In some embodiments, the food additive can be frozen when added to package in order to allow heat sealing mechanisms to function appropriately. That is, when a liquid food additive is added to package, the liquid nature of the food additive can interfere with the heat sealing process, producing a non-hermetic seal.

In some embodiments, the food additive can comprise one or more enzymatic tenderizers to form a tenderized meat product. Particularly, one or more proteolytic enzymes can be added to the food additive to sever peptide bonds in proteins, and therefore tenderize the meat. Proteolytic enzymes suitable for use with the presently disclosed subject matter can include, but are not limited to, bromelain from pineapple and papain from papaya, achromopeptidase, aminopeptidase, ancrod, angiotensin converting enzyme, bromelain, calpain, calpain I, calpain II, carboxypeptidase A, carboxypeptidase B, carboxypeptidase G, carboxypeptidase P, carboxypeptidase W, carboxypeptidase Y, caspase, caspase 1, caspase 2, caspase 3, caspase 4, caspase 5, caspase 6, caspase 7, caspase 8, caspase 9, caspase 10, caspase 11, caspase 12, caspase 13, cathepsin B, cathepsin C, cathepsin D, cathepsin G, cathepsin H, cathepsin L, chymopapain, chymase, chymotrypsin a-, clostripain, collagenase, complement Clr, complement Cls, complement Factor D, complement Factor I, cucumisin, dipeptidyl peptidase IV, elastase (leukocyte), elastase (pancreatic), endoproteinase Arg-C, endoproteinase Asp-N, endoproteinase Glu-C, endoproteinase Lys-C, enterokinase, factor Xa, ficin, furin, granzyme A, granzyme B, HIV protease, IGase, kallikrein tissue, leucine aminopeptidase (general), leucine aminopeptidase (cytosol), leucine aminopeptidase (microsomal), matrix metalloprotease, methionine amiopeptidase, neutrase, papain, pepsin, plasmin, prolidase, pronase E, prostate specific antigen, protease (alkalophilic form), *Streptomyces griseus*, protease from *Aspergillus*, protease from *Aspergillus saitoi*, protease from *Aspergillus sojae*, protease (*B. licheniformis*) (Alkaline), protease (*B. licheniformis*) (Alcalase), protease from *Bacillus polymyxa*, protease from *Bacillus* sp, protease from *Bacillus* sp (*Esperase*), protease from *Rhizopus* sp., protease S, proteasomes, proteinase from *Aspergillus oryzae*, proteinase 3, proteinase A, proteinase K, protein C, pyroglutamate amiopeptidase, renin, rennin, streptokinase, subtilisin, thermolysin, thrombin, tissue plasminogen activator, trypsin, tryptase, urokinase, and combinations thereof.

In some embodiments, the food additive can comprise additional components, including but not limited to, bactericides, fungicides or other preservatives, wetting agents (e.g., a Tween), antioxidants, viscosity control agents (e.g., gums), brine (e.g., sodium chloride, phosphates, dextrose), curing agents (e.g., nitrites, sugars, erythorbate), flavoring agents (e.g., herbs, spices, and liquid smoke), and the like.

Exemplary Embodiments of Methods of Using the Disclosed Package Assembly

As set forth in detail hereinabove, the second package 300 can be prepared such that the first film 315 of the second package can be formed into a compartment 325. A food additive 120 (e.g., a marinade) can be placed in the compartment 325. The second film 320 can hermetically seal the food additive 120 within the second package 300.

The first package 200 can be prepared such that first film 215 of the first package can be formed into first and second compartments 225 and 230. A food product 110 (e.g., a meat) can then be placed in the second compartment 230. The second package 300 containing the food additive 120 can be placed in the first compartment 230. Alternatively, the second package 300 can first be placed into the first compartment 225 of the first package and then the food additive 120 can be placed into the second package 300. The second film 220 of the first package can hermetically seal the food product 110 and the second package 300 and, thus, the food additive 120 within the second package 300.

Thus, in some embodiments, the presently disclosed subject matter is directed to a package assembly 100 for marinating and/or heating a food product. The package assembly 100 includes a first package 200 and a second package 300 contained within the first package 200. In some embodiments, each of the first and second package 200 and 300 package assembly can comprise a first thermoformed film 215 and 315 formed into a compartmented support member having one or more compartments (e.g., the first package 200 may have a first compartment 225 and a second compartment 230 and the second package 300 may have a compartment 325) and a second thermoplastic film 220, 320 disposed on the thermoformed film 215, 315. A food additive 120 can be disposed in the compartment 325 of the second package and the second package 300 can be disposed in the first compartment 225 of the first package. A food product 110 can be disposed in the second compartment 230 of the second package. The first and second films 215, 220 of the first package can then be sealed together to form a perimeter seal 235 around the perimeter of the first package 200. The perimeter seal 235 of the first package may be a hard seal in that the seal is not intended to rupture (e.g., the strength of the seal may be at least equal to the strength of the first and second films.). The first and second films 315, 320 of the second package can be sealed together to form a perimeter seal 335 around the perimeter of the second package 300. At least a portion **335*a* of the perimeter seal of the second package, e.g., the portion extending across a flange 360 of the second package, can be a rupturable seal. The rupturable seal 335*a* is configured to rupture in response to applied pressure, e.g., the strength of the seal 335*a* may be less than that of any of the films 215, 220, 315, 320 of the first and second package and less than the perimeter seal 235 of the first package. The flange 360 of the second package can extend from the first compartment 225 of the first package at least partially over a partition 240 between the first and second compartments 225, 230 of the first package toward the second compartment 230 of the first package such that the second package 300 is in fluid communication with the second compartment 230 of the first package when the rupturable seal 335***a* ruptures.

At a desired time, a user can grip the package assembly 100, and using his or her thumbs or a hard object, emit pressure on the first compartment 225 of the first package and thus onto the second package 300 contained substantially therein. Upon the increased pressure, the rupturable seal 335*a* of the second package will fail, allowing the food additive 120 contained in the second package 300 to flow from the compartment 325 of the second package through the flange 360 of the second package and into the second compartment 230 of the first package to freely mix with the food product 110 stored in the second compartment 230 of the first package. The perimeter seal 235 of the first package is configured to be strong enough to minimize the likelihood that the perimeter seal 235 would rupture or otherwise leak during this process and thus the food additive 120 and the food product 110 are contained within the first package 200 even when the pressure is applied for the user. In order to facilitate mixing, the user can shake or rotate the package assembly 100 to fully mix the food product 110 and the food additive 120.

The package assembly 100 can then be marinated for a desired amount of time. In some embodiments, the package assembly 100 can be incubated a sufficient time to allow the food product to tenderize to a desired amount. Thus, in some embodiments, the presently disclosed subject matter is directed to a method of controlling the level of food additive imparted to a food product. The method may comprise forming a second package including thermoforming a first thermoplastic film of the second package into a compartmented support member having a compartment; forming a first package including thermoforming a first thermoplastic film of the first package a compartmented support member having at least two compartments; loading the compartment of the second package with a food additive; applying a vacuum to the compartment of the second package; sealing the compartment with a second thermoplastic film of the second package and defining a flange of the second package, wherein the sealing includes providing a rupturable seal across the flange; loading the second package into the first compartment of the first package such that the flange of the second package extends at least partially over a partition between the first and second compartments of the first package; loading a food product in the second compartment of the first package; applying a vacuum to at least the second compartment of the first package; and sealing the first and second compartments of the first package with a second thermoplastic film of the first package, wherein the sealing includes providing a hard seal around the perimeter of the first package.

In addition to the advantages that would be evident to one skilled in the art regarding the presently disclosed subject matter, the use of a second package to contain the food additive may have one or more additional advantages. For example, rather than loading the food additive directly into the first compartment of the first package around the same time as the loading of the food product directly into the second compartment of the first package, the loading of the food additive into a second package first may minimize the likelihood of any premature cross-contamination between the food additive and the food product. Moreover, loading the food additive and the food product directly into compartments at the same time may require that the food additive be frozen to allow the machinery to advance rapidly as well as to prevent flashing of a liquid as the vacuum is applied to the food product. Freezing the food additive may be costly and require time and the maintenance of an environment below 0° F. The thawing of the food additive after the packaging operations may create condensation on the surface of the package which may create aesthetic issues and may transfer to any cardboard boxing packaging used in connection with the package and weaken the cardboard. In the presently disclosed subject matter, in some embodiments, the food additive may be handled as a liquid which may allow for more options for handling and flashing of the liquid may be eliminated because less vacuum may be needed to pull the surface air from the package. Also, using a liquid would eliminate the limitations of a frozen food additive as discussed above.

Also, the use of a second package for the food additive, allows for the first package to be specifically configured to hold the food product and the second package to be specifically configured to hold the food additive. For example, the materials of the first package can be "breathable" which may be preferred for food products such as fish or chicken and the materials of the second package may include barrier layers which may be preferred for the food additive. The second packages may be labeled or printed individually and then placed in a first package so a customer may change from one type to another type of food additive without changing the top web of film used for the first package even if it is printed for a particular food product.

The use of the second package also allows for the seals to be specifically configured for particular functions. For example and as discussed above, the perimeter seal of the first package may be a hard seal that reduces the likelihood of the first package rupturing or otherwise leaking even as the user applies pressure or shakes the package assembly to mix the food additive and food product, while the rupturable seal of the second package is specifically configured to rupture and allow the food additive and the food product to mix.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A package assembly for marinating a food product, the package assembly comprising:

a first package includes a first compartment configured to at least partially contain a second package and a second compartment configured to contain the food product; and the second package contained within the first compartment and configured to contain a food additive, the second package including a rupturable seal configured to rupture when exposed to a predetermined pressure, wherein the second package is in fluid communication with the second compartment upon the rupturing of the rupturable seal so as to allow the food additive to mix with the food product, and wherein the first package includes a hard seal configured to withstand the predetermined pressure and prevent leaking of the food additive and food product from the first package during the mixing of the food additive and the food product and the second package defines a flange configured to extend at least partially into the second compartment of the first package, and said flange is configured to serve as a conduit and direct the food additive to the second compartment in an instance in which the rupturable seal is ruptured.

2. The package assembly according to claim 1, wherein the first package includes a first plastic film and a second plastic film and the hard seal extends around the perimeter of the first plastic film and the perimeter of the second plastic film.

3. The package assembly according to claim 2, wherein the first plastic film is a thermoformed film formed into a compartmented support member having the first and second compartments.

4. The package assembly according to claim 3, wherein the second package includes a first plastic film of the second package that is a thermoformed film formed into a compartmented support member of the second package having a compartment of the second package and a second plastic film of the second package and wherein the first plastic film of the second package and the second plastic film of the second package collectively form a flange of the second package extending away from the compartment of the second package and the rupturable seal extends at least across the flange of the second package.

5. The package assembly according to claim 4, wherein the rupturable seal extends around the perimeter of the first plastic film of the second package and the perimeter of the second plastic film of the second package.

6. The package assembly according to claim 4, wherein the first and second compartments of the first package are separated by a partition and the flange of the second package extends from the compartment of the second package at least partially across the partition toward the second compartment of the first package.

7. The package assembly according to claim 6 further comprising a seal between the flange and the first plastic film of the first package and a seal between the flange and the second plastic film of the first package.

8. A package assembly comprising:

a food product;

a food additive;

a first package comprising a first compartment that at least partially contains a second package and a second compartment that contains the food product; and the second package that contains the food additive and includes a rupturable seal configured to rupture and allow the food additive to escape the second package when exposed to a predetermined pressure, wherein the second package is in fluid communication with the second compartment upon a rupturing of the rupturable seal so as to allow the food additive to mix with the food product, and wherein the first package is configured to withstand the predetermined pressure and prevent leaking of the food additive and food product from the first package during the mixing of the food additive and the food product and the second package defines a flange configured to extend at least partially into the second compartment of the first package, and said flange is configured to serve as a conduit and direct the food additive to the second compartment in an instance in which the rupturable seal is ruptured.

9. The package assembly according to claim 8, wherein the first package includes a first plastic film of the first package and a second plastic film of the first package sealed together by a hard seal configured to withstand the predetermined pressure.

10. The package assembly according to claim 9, wherein the second package includes a first plastic film of the second package and a second plastic film of the second package sealed together at least partially by the rupturable seal.

11. The package assembly according to claim 10, wherein the first plastic film of the second package and the second plastic film of the second package collectively form a flange of the second package and the rupturable seal extends at least across the flange of the second package.

12. The package assembly according to claim 11, wherein the rupturable seal extends around the perimeter of the first plastic film of the second package and the perimeter of the second plastic film of the second package.

13. The package assembly according to claim 12, wherein the first and second compartments of the first package are separated by a partition and the flange of the second package extends from the first compartment of the first package at least partially across the partition toward the second compartment of the fist package.

14. The package assembly of claim 8, wherein the food additive is selected from the group comprising: marinade, proteolytic enzyme, bactericide, fungicide, preservative, wetting agent, antioxidant, viscosity control agent, brine, curing agent, flavoring agent, and combinations thereof.

15. The package assembly of claim 14, wherein the food product is selected from the group comprising: meat, vegetable, and combinations thereof.

16. A method of controlling a level of food additive imparted to a food product, the method comprising:

forming a support member of a first package that includes a first compartment configured to at least partially contain a second package and a second compartment configured to contain a food product;

forming and configuring the second package to contain a food additive;

loading the food additive into the second package;

sealing the food additive in the second package with at least a rupturable seal configured to rupture and allow the food additive to escape the second package;

loading the food product into the second compartment of the first package;

loading the second package at least partially into the first compartment of the first package such that the second package is in fluid communication with the second compartment of the first package upon a rupturing of the rupturable seal so as to allow the food additive to mix with the food product;

sealing the support member of the first package with a cover of the first package such that the first package is configured to withstand the predetermined pressure and prevent leaking of the food additive and food product from the first package during the mixing of the food additive and the food product and the second package defines a flange, wherein loading the second package at least partially into the first compartment of the first package comprises loading the second package into the first package such that the flange of the second package at least partially extends into the second compartment, and said flange is configured to serve as a conduit and direct the food additive to the second compartment in an instance in which the rupturable seal is ruptured.

17. The method according to claim 16 further comprising applying a vacuum to the second package during or prior to the sealing of the second package and applying a vacuum to at least the second compartment during or prior to the sealing of the first package.

18. The method according to claim 17, wherein the forming of the supporting member includes thermoforming a first plastic film of the first package.

19. The method according to claim 18, wherein the forming of the second package includes thermoforming a first plastic film of the second package into a support member of the second package having an compartment of the second package.

20. The method according to claim 19, wherein loading the second package at least partially into the first compartment of the first package includes positioning a flange of the second package at least partially across a partition separating the first compartment of the first package and the second compartment of the first package such that the flange extends from the first compartment of the first package toward the second compartment of the second package.

* * * * *